US007550958B2

(12) United States Patent
Lee et al.

(10) Patent No.: US 7,550,958 B2
(45) Date of Patent: Jun. 23, 2009

(54) BANDGAP VOLTAGE GENERATING CIRCUIT AND RELEVANT DEVICE USING THE SAME

(75) Inventors: Chao-Cheng Lee, Hsin-Chu (TW); Cheng-Chung Hsu, Chang-Hua Hsien (TW)

(73) Assignee: Realtek Semiconductor Corp., HsinChu (TW)

( * ) Notice: Subject to any disclaimer, the term of this patent is extended or adjusted under 35 U.S.C. 154(b) by 292 days.

(21) Appl. No.: 11/611,137

(22) Filed: Dec. 15, 2006

(65) Prior Publication Data

US 2007/0139030 A1 Jun. 21, 2007

(30) Foreign Application Priority Data

Dec. 15, 2005 (TW) ..... 94144515 A

(51) Int. Cl.
*G05F 3/16* (2006.01)

(52) U.S. Cl. ..... 323/315; 323/901; 327/539

(58) Field of Classification Search ..... 323/311–316; 327/538–542

See application file for complete search history.

(56) References Cited

U.S. PATENT DOCUMENTS 6,677,808 B1 * 1/2004 Sean et al. ..... 327/539
6,906,581 B2 6/2005 Kang
7,122,998 B2 10/2006 Chen
7,132,821 B2 * 11/2006 Camara et al. ..... 323/315
2003/0201822 A1 10/2003 Kang

FOREIGN PATENT DOCUMENTS

| | | |
|---|---|---|
| TW | 574782 | 2/2004 |
| TW | 595107 | 6/2004 |
| TW | I234926 | 6/2005 |
| TW | I240493 | 9/2005 |
| TW | I241777 | 10/2005 |

* cited by examiner

*Primary Examiner*—Rajnikant B Patel
(74) *Attorney, Agent, or Firm*—Winston Hsu

(57) ABSTRACT

A bandgap voltage generating circuit includes a circuit coupled to a first node and a second node, driving the first and the second nodes to the same voltage level. A first impedance element is coupled to the first node and a second impedance element is coupled to the second node, wherein the impedance of the second impedance element is larger than the impedance of the first impedance element. A first transistor is coupled to the first impedance element, and a second transistor is coupled to the second impedance element and the first transistor. The bandgap generating circuit generates a bandgap voltage at the second node.

7 Claims, 7 Drawing Sheets

BANDGAP VOLTAGE GENERATING CIRCUIT AND RELEVANT DEVICE USING THE SAME

BACKGROUND OF THE INVENTION

1. Field of the Invention

The invention relates to a voltage generating circuit, and more particularly, to a bandgap voltage generating circuit with a low standby current.

2. Description of the Prior Art

In the field of IC design, an accurate voltage is often utilized. This accurate voltage, commonly known as the bandgap voltage, can compensate temperature and manufacturing process variations of the IC. In other words, the bandgap voltage is not influenced by temperature and differences in the manufacturing process. The bandgap voltage generating circuit usually operates with a voltage regulator to transform the bandgap voltage into another voltage level that can be utilized by circuits.

Generally speaking, the theory behind the bandgap voltage generating circuit is to add a voltage having a positive temperature coefficient to another voltage having a negative temperature coefficient such that a voltage not related to the temperature can be obtained. For example, assume that there is a voltage $V_1$ having a positive temperature coefficient and a voltage $V_2$ having a negative temperature coefficient. An appropriate constant M is selected to make $V_1+MV_2=V_{bg}$, where the voltage $V_{bg}$ is the above-mentioned bandgap voltage, and is not dependent on temperature in most cases.

Please refer to FIG. 1, which is a diagram of a conventional bandgap voltage regulator 100. The bandgap voltage regulator 100 comprises a start-up circuit 110, a bandgap generating circuit 120, and a voltage regulator 130.

In the bandgap voltage generating circuit 120, the voltages of the nodes A and B in the zone 121 are the same. Therefore, the circuit of the zone 120 can be simplified as zone 122 to become the equivalent circuit shown in FIG. 2. Since the voltages of nodes A and B are equal, the zone 122 can also be seen as a loop. The current $I_3$ flowing through the loop is generated by the voltage difference $V_{BE1}-V_{BE2}$ between the emitter and the base of the BJTs $Q_1$ and $Q_2$ and the resistor $R_1$. In other words, the current $I_3$ can be represented by the following equation:

$$I_3=(V_{BE1}-V_{BE2})/R_1 \quad \text{equation (1)}$$

where $V_{BE1}=V_T \ln(I_{c1}/I_s)$, $V_{BE2}=V_T \ln(I_{c2}/I_s)$ such that the following equation can be obtained.

$$\begin{aligned} I_3 &= V_T[\ln(Ic_1/Is_1)-\ln(Ic_2/Is_2)]/R_1 \quad \text{equation (2)} \\ &= V_T[\ln(n)]/R_1 \end{aligned}$$

Please note that the value n, which is equal to $(Ic_1*Is_2)/(Is_1*Ic_2)$, can be determined by the circuit designer. From the above equation (2), it can be seen that the current $I_3$ is a current having a positive temperature coefficient. Referring to FIG. 1, the current $I_4$ could be seen as a copy of current $I_3$ by using a current mirror. Therefore, after passing through the resistor $R_2$, the current $I_4$ is transformed into a voltage having a positive temperature coefficient. This can be illustrated by the following equation:

$$V_{R2}=V_T[In(n)]*(R_2/R_1) \quad \text{equation (3)}$$

Furthermore, from referring to chapter 4.4.3 of the textbook "Analysis and Design of Analog Integrated Circuits (4th Edition) by Paul R. Gray, et al", the voltage difference $V_{BE}$ between the base and the emitter of the BJT can be represented by the following equation (4):

$$V_{BE}=V_{bg}-V_T(a*InT-InK) \quad \text{equation (4)}$$

As $V_{bg}$, a, and K are all constants (meaning that they are not influenced by temperature), and $V_T$ and T are variables, which have positive temperature coefficients, the voltage difference $V_{BE}$ is a voltage having a negative temperature coefficient.

As the voltage level $V_C$ of node C is the sum of the voltage difference $V_{BE3}$ and the voltage drop across the resistor $R_2$, it can be represented by the following equation:

$$\begin{aligned} V_C &= V_{BE3}+V_{R2} \quad \text{equation (5)} \\ &= V_{bg}-V_T(a_3*\ln T-\ln K_3)+V_T[\ln(n)]*(R_2/R_1) \end{aligned}$$

Similarly, the circuit designer can define parameters of the above-mentioned devices (such as the transistors or the resistors) such that the voltage $V_C$ of node C can be equal to the bandgap voltage $V_{bg}$.

In addition, the conventional voltage regulator 130 comprises an operational amplifier 131 and a voltage dividing circuit 132. The voltage regulator 130 can generate a regulated voltage at the node D according to the above-mentioned bandgap voltage $V_{bg}$ at the node C. The voltage dividing circuit 132 can divide the regulated voltage to generate a divided voltage at the node E. The divided voltage is fed back to the input end of the operational amplifier 131. Therefore, the operational amplifier 131 generates the regulated voltage according to the fed back divided voltage and the bandgap voltage $V_{bg}$. In the same way, the circuit designer can adjust the resistance of the resistors $R_4$ and $R_3$ such that an appropriate voltage can be generated to be used by the core circuit 140.

The detailed architecture of the start-up circuit 110 is shown in FIG. 1. The start-up circuit 110 is to allow the bandgap voltage generating circuit 120 to work normally. The detailed operation of the start-up circuit 110 is well known, and thus omitted here.

Although the above-mentioned bandgap voltage regulator 100 provides a relatively accurate regulated voltage, the bandgap voltage regulator 100 consumes currents $I_0$~$I_5$ in addition to the operating current of the operational amplifier 131. Even during the time when the core circuit 140 is in standby mode, regulated voltage is still provided by the bandgap voltage regulator 100 such that the core circuit 140 can successfully switch itself from standby mode into active mode. The large power consumption of the currents will thus reduce the life expectancy of circuit power supplies of electronic appliances.

SUMMARY OF THE INVENTION

It is therefore one of the objectives of the claimed invention to provide a bandgap voltage generating circuit and a bandgap voltage regulator with a low consuming current, to solve the above-mentioned problem.

According to an exemplary embodiment of the claimed invention, a bandgap generating circuit is disclosed. The bandgap generating circuit comprises: a first circuit, coupled to a first node and a second node, for making the first node and the second node correspond to the same voltage level; a first impedance element, coupled to the first node; a second impedance element, coupled to the second node, an impedance of the second impedance element being larger than that of the first impedance element; a first transistor, coupled to the first impedance element; and a second transistor, coupled to the second impedance element and the first transistor; wherein the bandgap voltage generating circuit generates a bandgap voltage at the second node.

According to another exemplary embodiment of the claimed invention, a bandgap voltage regulator is disclosed. The bandgap voltage regulator comprises: a bandgap voltage generating circuit, for providing a bandgap voltage, the bandgap voltage generating circuit comprising: a first circuit, coupled to a first node and a second node, for making the first node and the second node correspond to the same voltage level; a first impedance element, coupled to the first node; a second impedance element, coupled to the second node, an impedance of the second impedance element being larger than that of the first impedance element; a first transistor, coupled to the first impedance element; and a second transistor, coupled to the second impedance element and the first transistor; wherein the bandgap generating circuit generates a bandgap voltage at the second node; and a voltage regulator, for outputting a regulated voltage according to the bandgap voltage.

According to another exemplary embodiment of the claimed invention, a bandgap voltage generating device for providing a voltage to a core circuit operating in a standby mode or an active mode is disclosed. The bandgap voltage generating device comprises: a first bandgap voltage regulator, coupled to the core circuit, for generating a first bandgap voltage; a second bandgap voltage regulator, coupled to the core circuit, for generating a second bandgap voltage, wherein when the core circuit is in standby mode, the second bandgap voltage regulator does not work; and a controller, coupled to the first bandgap voltage regulator, the second bandgap voltage regulator, and the core circuit, for switching the core circuit between standby mode and active mode and activating the second bandgap voltage regulator when the core circuit is in active mode.

These and other objectives of the present invention will no doubt become obvious to those of ordinary skill in the art after reading the following detailed description of the preferred embodiment that is illustrated in the various figures and drawings.

DETAILED DESCRIPTION

Figure 3:
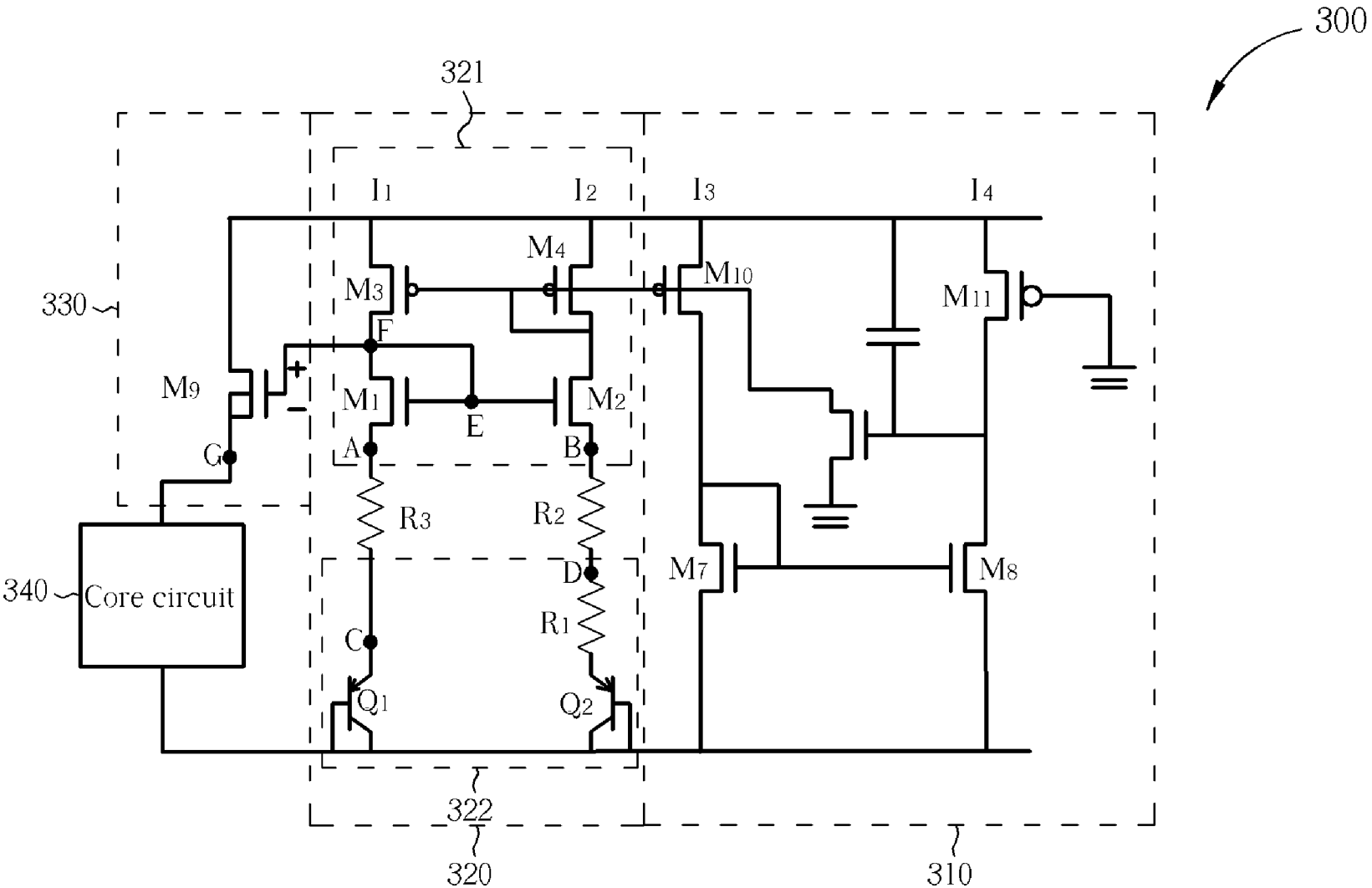
FIG. 3 is a diagram of a bandgap voltage regulator of a first embodiment according to the present invention.

Please refer to FIG. 3, which is a diagram of a bandgap voltage regulator 300 of a first embodiment according to the present invention. The bandgap voltage regulator 300 comprises a start-up circuit 310, a bandgap voltage generating circuit 320, and a voltage regulator 330. The bandgap voltage generating circuit 320 is utilized to generate a bandgap voltage $V_{bg}$, and the voltage regulator 330 is utilized to generate a regulated voltage according to the bandgap voltage $V_{bg}$. In addition, in this embodiment, the function of the start-up circuit 310 is the same as that of the above-mentioned start-up circuit 110. The start-up circuit 310 is also utilized to keep the bandgap voltage generating circuit 320 in a predetermined steady state such that the bandgap voltage generating circuit 320 can generate the bandgap voltage $V_{bg}$ accurately.

Figure 2:
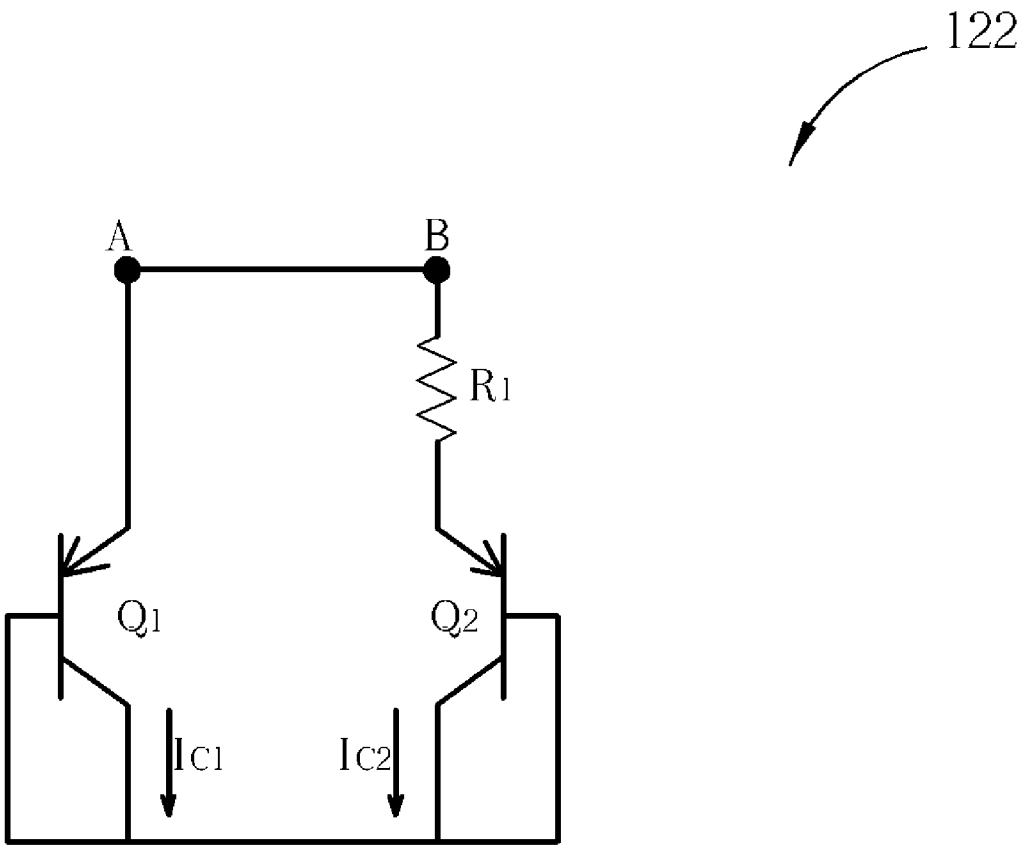
FIG. 2 is a diagram of a zone of the conventional bandgap voltage regulator shown in FIG. 1.

In addition, the bandgap generating circuit 320 also comprises a zone 321. The zone 321 is similar to the zone 121; therefore the voltages of the node A and the node B should also be the same. Furthermore, in this embodiment, the resistances of the resistors $R_2$ and $R_3$ are the same. Theoretically, the voltages of the node C and the node D are the same. The zone 322 is equivalent to the circuit diagram shown in FIG. 2. In other words, the current $I_2$ is generated due to the voltage differences $V_{BE1}-V_{BE2}$ of the BJTs $Q_1$ and $Q_2$, and the resistor $R_1$. The current $I_2$ can be represented by:

$$I_2 = (V_{BE1} - V_{BE2})/R_1 \quad \text{equation (6)}$$
$$= V_T[\ln(n)]/R_1$$

The current $I_2$ is the current having a positive temperature coefficient. In this embodiment, the current $I_2$ passes through the resistor $R_2$ to generate a voltage also having a positive temperature coefficient. The voltage $V_B$ of node B is the sum of the resistor ($R_1$+$R_2$), and the voltage difference $V_{BE2}$ between the base and the emitter of the BJT $Q_2$. It can be represented by the following equation.

$$V_B = V_{BE2} + V_{(R1+R2)} \quad \text{equation (7)}$$
$$= V_{BE2} + V_{R1} + V_{R2}$$
$$= V_{BE2} + R_1(V_{BE1} - V_{BE2})/R_1 + V_T[\ln(n)](R_2/R_1)$$
$$= V_{BE1} + V_T[\ln(n)](R_2/R_1)$$

As the voltage difference between the base and the emitter is a voltage having a negative temperature coefficient, the above-mentioned equation (4) can be combined with equation (7) such that the following equation (8) can be obtained.

$$V_B=V_{bg}-V_T(a*InT-InK)+V_T[In(n)](R_2/R_1) \quad \text{equation (8)}$$

Similarly, the circuit designer can appropriately adjust parameters of each device (such as the transistors or the resistor) such that a voltage at the node B, which is not dependent on temperature, can be generated.

The present invention utilizes a resistor $R_2$ in series with the resistor $R_1$, and utilizes another resistor $R_3$ to match the resistor $R_2$ in order to make the voltages of the node C and the node D equal. Furthermore, the present invention utilizes the voltage of the resistor $R_2$ and the voltage difference between the base and the emitter of the transistor $Q_2$ to generate the bandgap voltage $V_{bg}$.

In FIG. 3, the voltage level of the node B is the bandgap voltage $V_{bg}$, and the voltage level $V_E$ of the node E is the sum of the bandgap voltage $V_{bg}$ and the voltage difference between the gate and the source of the transistor $M_2$. $V_E$ can be represented by the following equation:

$$V_E=V_{bg}+V_{GS2} \quad \text{equation (9)}$$

Moreover, the voltage level at the node E is the same as that of the node F. Therefore, the voltage level $V_G$ of the node G is equal to that the voltage level $V_E$ of the node E minus the voltage difference between the gate and the source of the transistor $M_9$. $V_G$ can be represented by the following equation:

$$V_G = V_E - V_{GS9} \quad \text{equation (10)}$$
$$= V_{bg} + V_{GS2} - V_{GS9}$$

The circuit designer can properly adjust the parameters of the transistors $M_2$ and $M_9$ to select the above-mentioned voltage differences $V_{GS2}$ and $V_{GS9}$ such that a required regulated voltage can be obtained. For example, if the voltage differences between the gate and the source of the transistors $M_2$ and $M_9$ are the same, the voltage level of the node G can substantially correspond to the bandgap voltage $V_{bg}$. The circuit designer can also select different transistors such that the voltage level of the node G can correspond to difference voltage levels. This change also complies with the spirit of the present invention.

Figure 1:
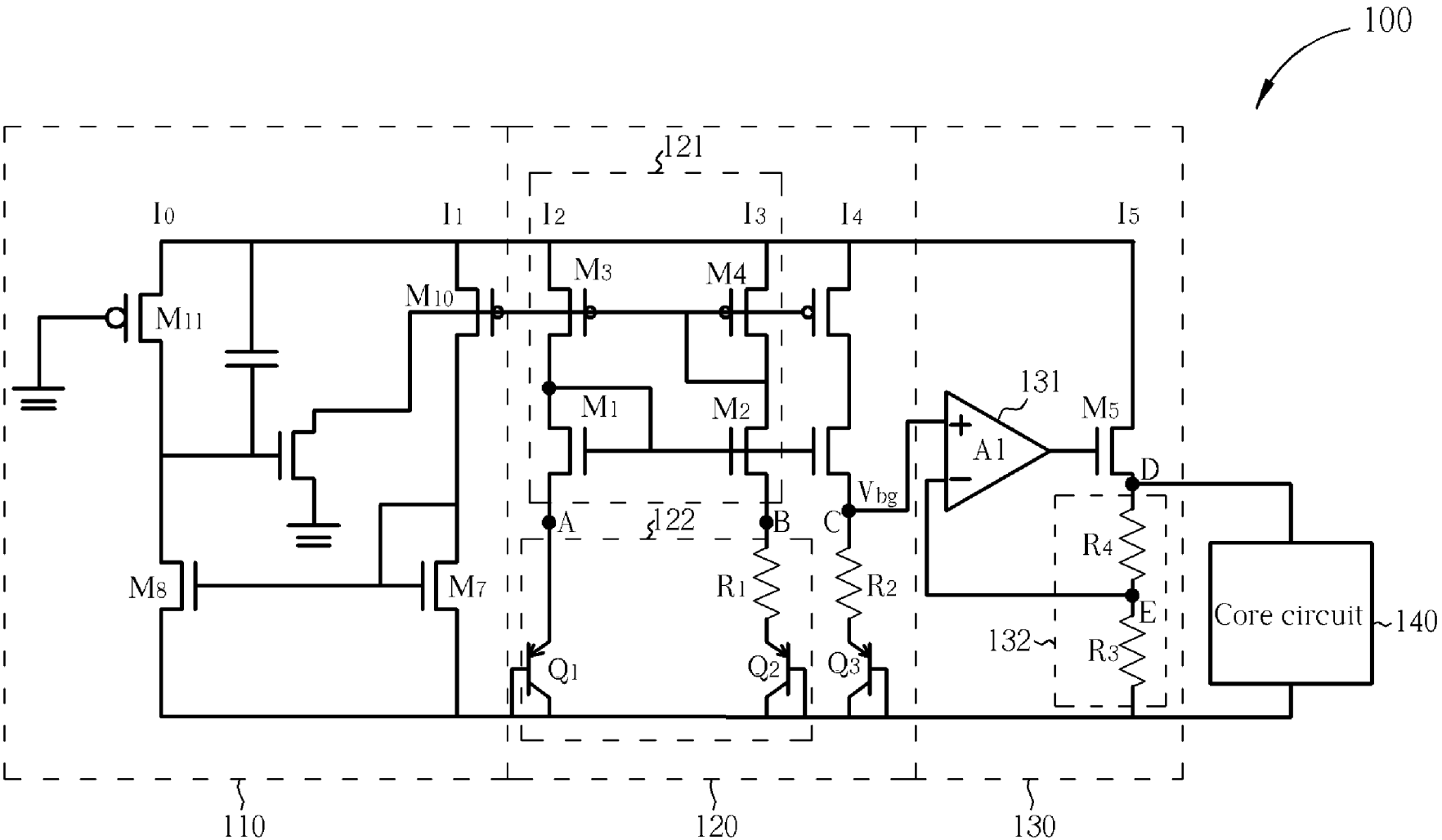
Fig. 1 Prior Art
FIG. 1 is a diagram of a conventional bandgap voltage regulator.

The bandgap voltage generating circuit 320 of the present invention does not need the current $I_4$ shown in FIG. 1, thus reducing power consumption. Furthermore, since the voltage regulator 330 does not include an operational amplifier, the current utilized by the voltage regulator 330 is also diminished. This makes the standby current much lower when the core circuit 340 is in standby mode.

Figure 4:
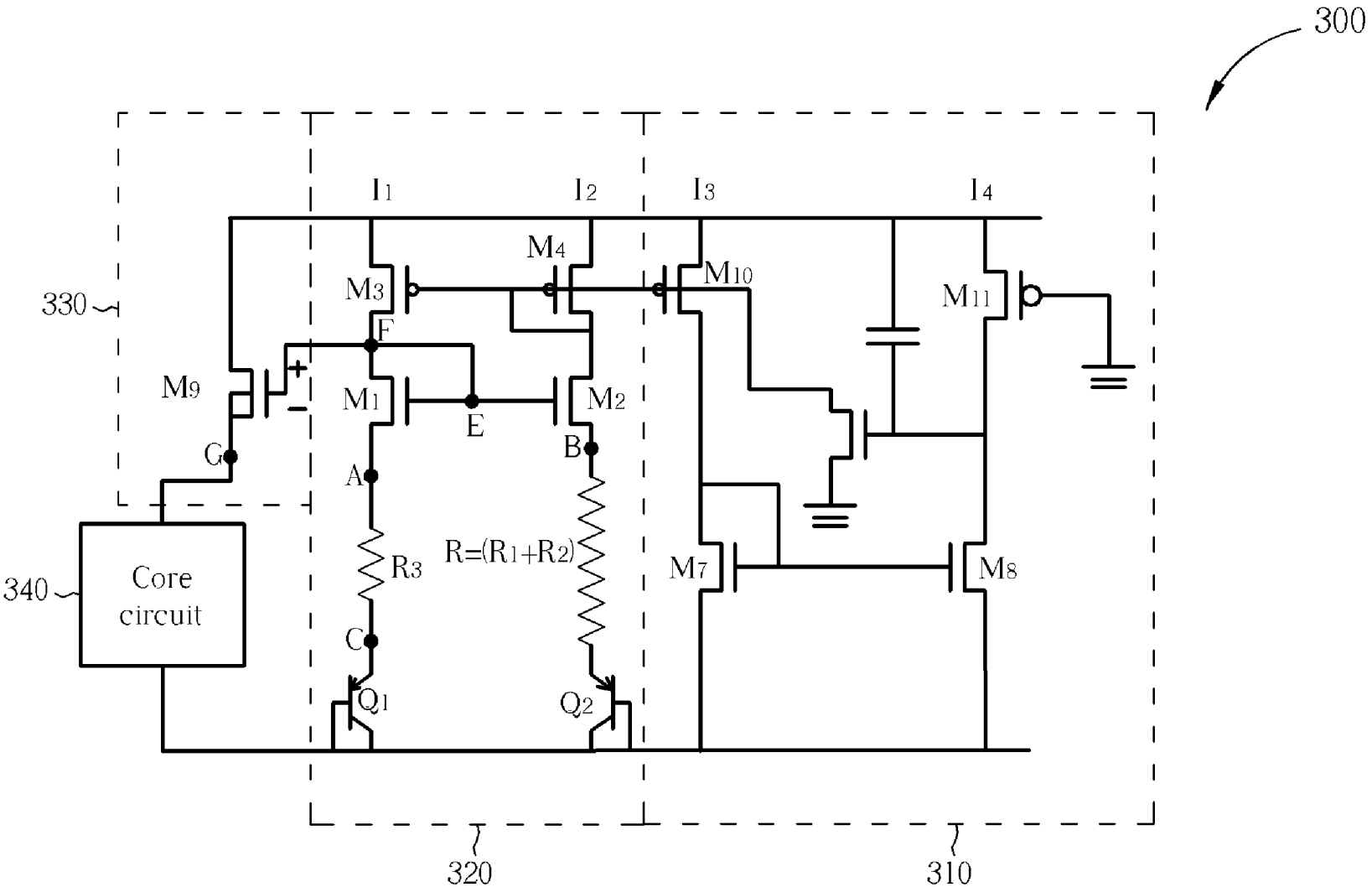
FIG. 4 is a diagram of a bandgap voltage regulator of a second embodiment according to the present invention.

Please refer to FIG. 4, which is a diagram of the bandgap voltage regulator 300 of a second embodiment according to the present invention. In the second embodiment, a single resistor R is utilized to replace the two resistors $R_1$ and $R_2$ of the first embodiment. Obviously, if the resistance of the resistor R corresponds to the total resistance of the two resistors $R_1+R_2$, the second embodiment is equivalent to the first embodiment. As the circuit operation and function of the second embodiment are the same as those of the first embodiment, the details are omitted here.

Figure 5:
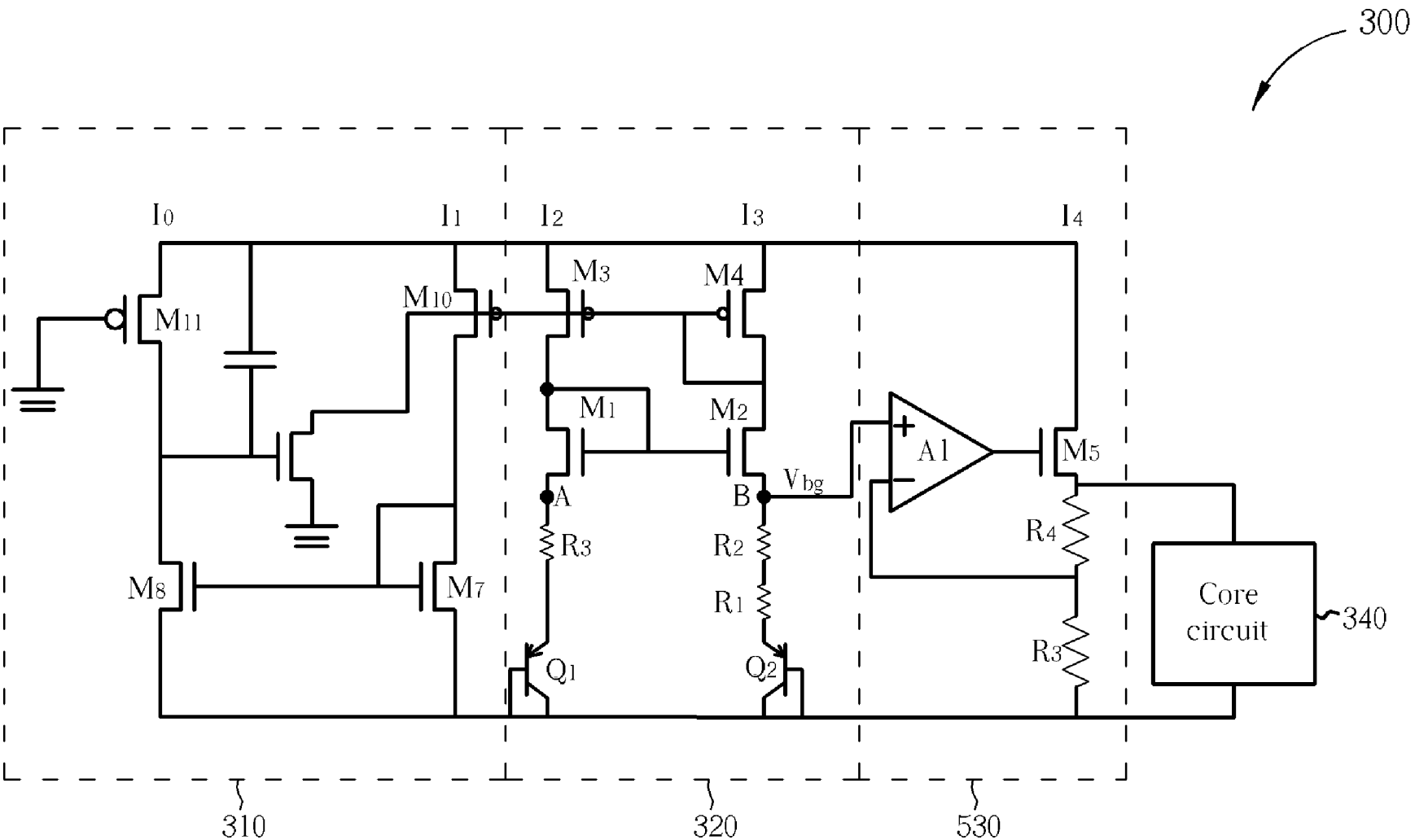
FIG. 5 is a diagram of a bandgap voltage regulator of a third embodiment according to the present invention.

Please refer to FIG. 5, which is a diagram of the bandgap regulator 300 of a third embodiment according to the present invention. In the third embodiment, the voltage regulator 530 utilizes the operational amplifier structure to generate a relatively accurate regulated voltage. In contrast to the circuit shown in FIG. 1, the circuit shown in FIG. 5 also removes the current $I_4$ shown in FIG. 1. In the third embodiment, resistors $R_1$ and $R_2$ can be replaced by a single resistor R. Those skilled in the art should understand the corresponding circuit structure and the function, and further illustration is thus omitted here.

Although the above-mentioned bandgap voltage regulator 300 consumes less power, meaning the standby current is lower when the core circuit 340 is in standby mode, the regulated voltage is relatively not so accurate due to the fact that the regulated voltage generated by the bandgap voltage regulator 300 utilizes an open loop at the transistor $M_9$. In other words, the bandgap voltage regulator 300 using an open loop structure is not appropriate when used in a high-speed digital circuit, which requires an accurate input voltage.

Figure 6:
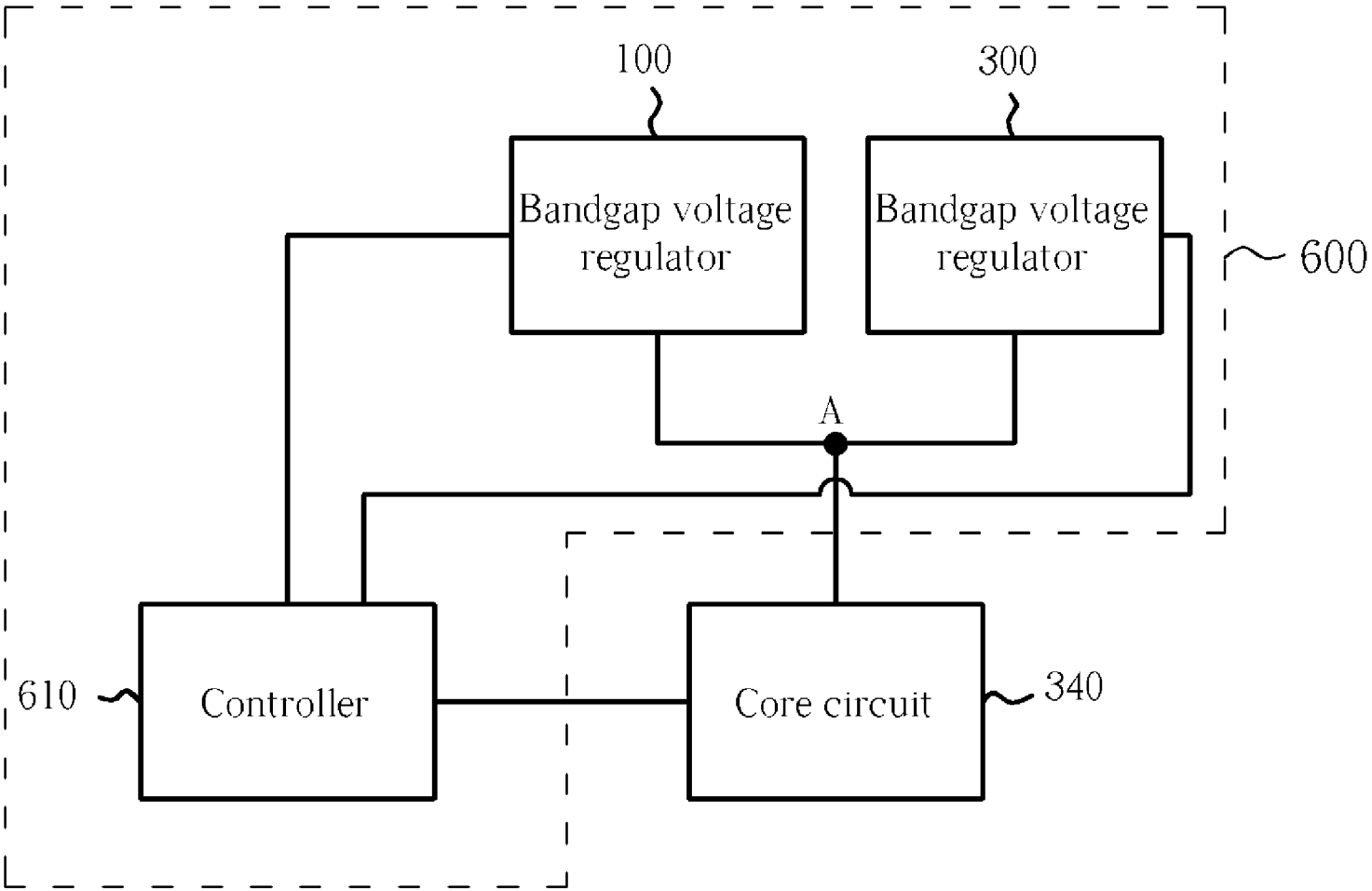
FIG. 6 is a diagram of a bandgap voltage generating device of a first embodiment according to the present invention.

Please refer to FIG. 6, which is a diagram of a bandgap voltage generating device 600 according to the present invention. As shown in FIG. 6, the bandgap voltage generating device 600 comprises a bandgap voltage regulator 300, a conventional bandgap voltage regulator 100, and a controller 610. The controller 610 is respectively coupled to the conventional bandgap voltage regulator 100, the bandgap voltage regulator 300, and the core circuit 340. The conventional bandgap voltage regulator 100, the bandgap voltage regulator 300, and the core circuit 340 are all coupled to the node A. The bandgap voltage generating device 600 provides the bandgap voltage continuously to the node A to keep the core circuit 340 running even during standby mode. However, during standby mode, the consumed current (the standby current) is preferably a low current. When the core circuit 340 is switched into active mode, the core circuit 340 should then be relatively accurate. Therefore, in the following disclosure, a bandgap generating device having the advantages of accurate input voltage and low standby current is disclosed.

The controller 610 shown in FIG. 6 is utilized to switch the core circuit 340 into active mode or standby mode. For example, the controller 610 can output an enable signal to the core circuit 340 to switch the core circuit 340 from the original standby mode into active mode. Alternatively, the controller 610 can output a disable signal to switch the core circuit from the original active mode to standby mode.

When the core circuit 340 is in standby mode (at this time, the core circuit 340 has not been activated yet), the controller 610 turns off the conventional bandgap voltage regulator 100, so at this time only the bandgap voltage regulator 300 works. As mentioned previously, the bandgap voltage regulator 300 consumes less power, which is however necessary for providing the bandgap voltage of node A and the operating voltage of the controller 610 in standby mode. The bandgap voltage generating device 600 therefore has a lower standby current during this time.

The controller 610 controls the core circuit 340 to switch the core circuit 340 from standby mode into active mode. As the core circuit 340 requires an accurate regulated voltage to work, the bandgap voltage regulator 300 is no longer utilized at this time. Instead, the controller 610 outputs the enable signal to the conventional bandgap voltage regulator 100 to turn on the bandgap voltage regulator 100 to generate an accurate regulated voltage. This enables the core circuit 340 to utilize the bandgap voltage generated by the bandgap voltage regulator 100 to perform a predetermined operation.

As the conventional bandgap voltage regulator 100 and the bandgap voltage regulator 300 are both coupled to node A, when the core circuit 340 is in active mode, the bandgap voltage regulator 300 and the bandgap voltage regulator 100 simultaneously output voltages to the node A. In this embodiment, however, some techniques are utilized to make the output current of the bandgap voltage regulator 100 larger than that of the bandgap voltage regulator 300. The voltage of node A will then be mainly determined by the bandgap voltage regulator 100. In other words, the bandgap voltage regulator 100 is dominant when the bandgap voltage regulator 300 and the bandgap voltage regulator 100 both work.

Please note that the above-mentioned techniques are well known by those skilled in the art. For example, the source of the transistor $M_9$ of the bandgap voltage regulator 300 and the source of the transistor $M_5$ of the bandgap voltage regulator 100 correspond to the same voltage level. Therefore, if the gate of the transistor $M_5$ corresponds to a higher voltage level, the output current of the bandgap voltage regulator 100 can be larger.

Please note that the input voltage required by the core circuit 340 in active mode can be different from that required by the core circuit 340 in standby mode. For example, because the core circuit 340 does not really work in standby mode, the core circuit 340 can utilize a lower voltage for ensuring that the core circuit 340 can be activated later. Therefore, in this embodiment, the bandgap voltage regulator 100 and the bandgap voltage regulator 300 can output different voltage levels (for instance, the bandgap voltage regulator 100 can generate a higher voltage level). However, as mentioned previously, since the bandgap voltage regulator 100 provides a larger output current, the bandgap voltage regulator 100 can pull up the voltage level of the node A such that the bandgap voltage required can be generated when the core circuit 340 is in active mode.

Figure 7:
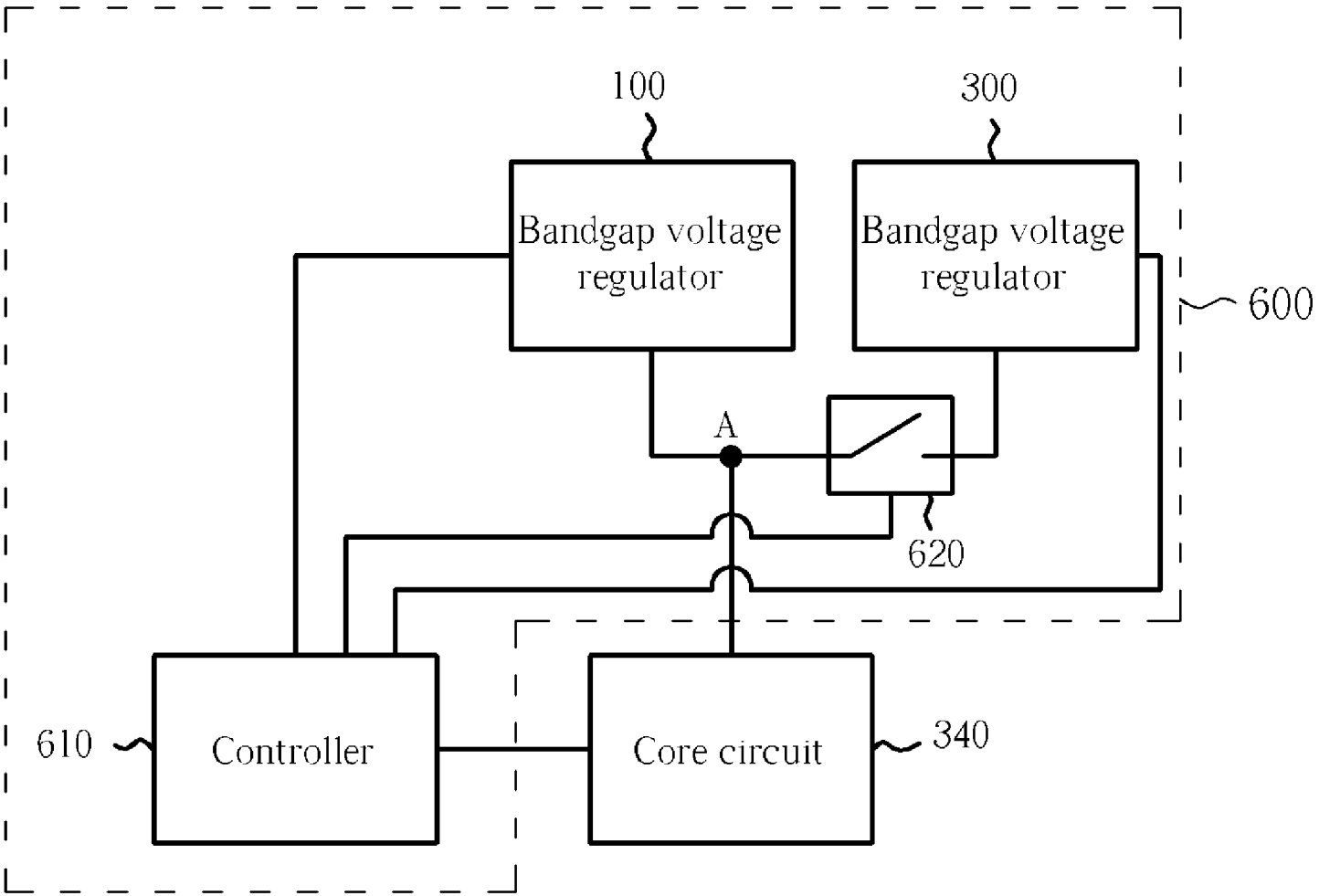
FIG. 7 is a diagram of a bandgap voltage generating device of a second embodiment according to the present invention.

Please refer to FIG. 7, which is a diagram of the bandgap voltage generating device 600 of a second embodiment according to the present invention. As shown in FIG. 7, the bandgap voltage generating device 600 also comprises the conventional bandgap voltage regulator 100, the bandgap voltage regulator 300, and a controller 610. The controller 610 is coupled to the bandgap voltage regulator 100, the bandgap voltage regulator 300, and a core circuit 340. The bandgap voltage generating device 600 of the second embodiment further comprises a switch 620 coupled between the bandgap voltage regulator 300 and the node A. The controller 610 is also coupled to the switch 620.

In this embodiment, the switch 620 breaks the electrical connection between the bandgap voltage regulator 300 and node A. In other words, when the controller 610 switches the core circuit 340 into active mode, the controller 620 simultaneously breaks the electrical connection between the bandgap voltage regulator 300 and node A, so that voltage output from the bandgap voltage regulator 300 to node A is interrupted. This means that the voltage level of node A is entirely determined by the bandgap voltage regulator 100. Please note that other operations of the second embodiment are the same as the first embodiment, and thus omitted here.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A bandgap voltage generating device, for generating a bandgap voltage to a node coupled to a core circuit, the bandgap voltage generating device comprising:

a first bandgap voltage regulator, coupled to the node, for generating a first bandgap voltage to the node;

a second bandgap voltage regulator, coupled to the core circuit, for generating a second bandgap voltage to the node, wherein the power consumption of the second bandgap voltage is less than the power consumption of the first bandgap voltage regulator; and a controller, coupled to the first bandgap voltage regulator and the second voltage regulator, for controlling the first bandgap voltage regulator and the second bandgap voltage regulator according to a mode of the core circuit;

wherein when the core circuit is operated in an standby mode, the first bandgap voltage regulator is disabled by the controller and the core circuit is powered by the second bandgap voltage regulator; and when the core circuit is operated in an active mode, the first bandgap voltage regulator is enabled by the controller and the core circuit is powered by at least the first bandgap voltage regulator.

2. The bandgap voltage generating device of claim 1, wherein when the core circuit is operated in the active mode, the first bandgap voltage and the second bandgap voltage are simultaneously generated to the node.

3. The bandgap voltage generating device of claim 1, wherein when the core circuit is operated in the standby mode, the second bandgap voltage regulator is disabled.

4. The bandgap voltage generating device of claim 1, wherein the second bandgap voltage regulator does not comprise an operational amplifier.

5. The bandgap voltage generating device of claim 1, wherein the second bandgap voltage is generated from a source terminal of a transistor.

6. The bandgap voltage generating device of claim 1, wherein the second bandgap comprises:

a first circuit, coupled to a first node and a second node, for making the first node and the second node correspond to a same voltage level;

a first impedance element, coupled to the first node;

a second impedance element, coupled to the second node, a first transistor, coupled to the first impedance element; and a second transistor, coupled to the second impedance element and the first transistor;

wherein an impedance of the second impedance element is larger than that of the first impedance element.

7. The bandgap voltage generating device of claim 6, wherein the first impedance element and the second impedance element are both resistors.

* * * * *